US009543133B2

(12) United States Patent
Decker

(10) Patent No.: US 9,543,133 B2
(45) Date of Patent: Jan. 10, 2017

(54) PROCESSING OF ION CURRENT MEASUREMENTS IN TIME-OF-FLIGHT MASS SPECTROMETERS

(75) Inventor: Jens Decker, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 478 days.

(21) Appl. No.: 13/417,910

(22) Filed: Mar. 12, 2012

(65) Prior Publication Data

US 2012/0228488 A1 Sep. 13, 2012

(30) Foreign Application Priority Data

Mar. 10, 2011 (DE) ..... 10 2011 013 600

(51) Int. Cl.
*H01J 49/40* (2006.01)
*H01J 49/00* (2006.01)

(52) U.S. Cl.
CPC ..... *H01J 49/0036* (2013.01)

(58) Field of Classification Search
CPC ..... H01J 49/0036; H01J 49/00; H01J 49/40; H01J 49/10; G01N 30/72
USPC ..... 702/22–23, 27; 250/281–287
See application file for complete search history.

(56) References Cited

U.S. PATENT DOCUMENTS 5,619,034 A * 4/1997 Reed et al. ..... 250/287
6,356,230 B1 3/2002 Greef et al.
6,870,156 B2 3/2005 Räther
7,412,334 B2 8/2008 Fjeldsted et al.
2004/0079877 A1 4/2004 Hidalgo et al.
2005/0255606 A1* 11/2005 Ahmed et al. ..... 436/173
2007/0252741 A1 11/2007 Hidalgo
2010/0001180 A1* 1/2010 Bateman et al. ..... 250/282
2012/0109537 A1 5/2012 Makarov

FOREIGN PATENT DOCUMENTS

WO 2004051850 6/2004

OTHER PUBLICATIONS

Charles Wilkins and Sarah Trimpin, "Ion Mobility Spectrometry—Mass Spectrometery: Theory and Applications", 2011, CRC Press, pp. 9-12.*
German Office Action dated Nov. 27, 2014.

* cited by examiner

*Primary Examiner* — Mischita Henson
(74) *Attorney, Agent, or Firm* — O'Shea Getz P.C.

(57) ABSTRACT

Aspects relate to methods for processing individual spectra acquired with a time-of-flight mass spectrometer to form a sum spectrum. The peak position of a peak and its total intensity are determined in an individual spectrum, and entries in an addition raster of the sum spectrum adjacent to the peak position are selected; then the total intensity is divided up into portions, wherein more of the total intensity is added to entries which are closer to the peak position than is added to entries which are further away from the peak position.

18 Claims, 3 Drawing Sheets

PROCESSING OF ION CURRENT MEASUREMENTS IN TIME-OF-FLIGHT MASS SPECTROMETERS

PRIORITY INFORMATION

This patent application claims priority from German Patent Application 10 2011 013 600.2 filed on Mar. 10, 2011, which is hereby incorporated by reference.

FIELD OF THE INVENTION

The invention relates to mass spectrometers, and in particular to methods and instruments for processing digitized ion current signals in time-of-flight mass spectrometers which acquire a large number of individual spectra and process them to form a sum spectrum.

BACKGROUND OF THE INVENTION

Most of the time-of-flight mass spectrometers used today acquire individual time-of-flight spectra in rapid succession. Hundreds to several hundred thousands of these individual spectra, which are acquired at a scanning rate of five thousand to thirty thousand spectra per second, are then immediately processed into a sum time-of-flight spectrum in order to obtain useful time-of-flight spectra with well-defined ion current signals (peaks) for the ion species of different masses. A method for improving the mass resolution has been used for some time; it includes adding the intensity of the peak only at the position of the peak maximum.

From the time-of-flight spectra, mass spectra are computed, using a calibrated transformation function. The purpose of many of these time-of-flight mass spectrometers is to determine the masses of the individual ion species as accurately as possible. Significant progress has been achieved in recent years; while approximately ten years ago a mass accuracy of 10 ppm was being aimed for (but rarely achieved), today the goal of 200 ppb is realistically on the horizon. As used here, the terms "ppm" (parts per million) and "ppb" (part per billion) for the accuracy refer to the relative accuracy of mass determination in parts per million or parts per billion of the mass, i.e., the relative deviation between the mass determined from a peak and the true value, averaged over many mass determinations. The precision (or reproducibility) is set statistically as sigma, the width parameter of the distribution of repeated measurements, with a tacit assumption of a normal distribution of the measurement variance. This width parameter gives the distance on the abscissa between the point of inflection and the maximum of the Gaussian normal distribution curve.

Nowadays, the target of 200 ppb is already being achieved for the reproducibility of the calculated masses in some high-quality types of time-of-flight mass spectrometers, but strangely not yet for the mass accuracy itself, i.e., for the accuracy of the mass determination. The masses are calculated using a calibration function, which represents the masses as a function of the times of flight of the peaks. If a smooth calibration curve is used to calculate the masses, for example a power series with only a few terms, as is theoretically required and expected, the values derived for the masses of different ion species reproducibly deviate from the true values toward slightly smaller or slightly larger values. These small deviations are of the order of a few hundred ppb, and are reproduced well in successive measurements. They thus point to systematic errors, but with erratic changes of size and direction of the systematic error within small mass intervals, hitherto not explainable.

The progress made in improving the reproducibility of the mass determination is attributable to a large number of individual improvements, such as improvement to the ion optics, stability of the electronics, thermal stability of the instrument, including the flight tube, resistance to vibrations, improvements to the ion detector and an increase in the sampling rate of the ion current measurements to four or five gigahertz all contribute to these improvements.

In time-of-flight mass spectrometers of this type, secondary electron multipliers (SEM) are used, without exception, in the ion detectors to measure the ion currents. They often take the form of multichannel plates (MCP), but there are also other embodiments. The multichannel plates have millions of channels of equal diameter each, which are arranged at an angle to the plane of the plates so that the ions cannot simply fly through. There are MCPs with channels of about 2 to 8 micrometers in diameter on the market. Two channel plates are usually connected in series with the channels at offset angles in order to achieve better amplification of the electron currents. The amplification can be set to values from $10^5$ to $10^7$ so that a single ion generates a signal of $10^5$ to $10^7$ secondary electrons, which are collected on an electrode. The detectors have a complicated structure in order not to generate any signal distortions; those skilled in the art are familiar with these arrangements, so that it is not necessary to explain these detectors in more detail here. In conjunction with a post-amplifier, they can be adjusted in such a way that a single ion generates a signal that stands out significantly from the electronic noise.

The process of avalanche-like secondary electron multiplication in the individual channels of the plates also results in a broadening of the amplified signal, however. The best ion detectors currently provide an electron current which is around 500 picoseconds wide from a single impinging ion. The signal widths are around one nanosecond or more if less expensive pairs of channel plates are used. Since the technology is mature, it is not to be expected that significant progress will be made here in the future.

Special electronic digitization units can be used for the temporal sampling and digitization of the electron current, whose integral over time is proportional to the ion current to a good approximation; these units are developed out of the known transient recorders and associated digital oscillographs. Nowadays, they operate with sampling rates of four to eight gigahertz. While the processing speed of other electronic components and systems doubles roughly every 1.5 to three years, the sampling rate in the field of transient recorders has not increased for a number of years. It is, however, to be expected that the digitization depth will improve from eight to ten or even twelve bits.

These special digitization units sample the electron current from the secondary electron multipliers in a fixed measuring time raster, at a sampling rate of five gigahertz, for example. The electron current from a single ion provides a series of five to fifteen measurement values above the noise for a conventional ion detector with full widths at half-maximum of 500 to 1000 picoseconds at a sampling rate of five gigahertz. If the digitized measurement values for ions of one mass from several individual spectra are summed, or if several ions of the same mass are detected in an individual spectrum, the signal widths become larger compared to the signal of an individual ion because residual focusing errors of the mass spectrometer, uncompensated effects of the initial energy distributions of the ions before they are pulsed out, and other effects come into play. At present, these effects still result in additional signal broadenings in the order of a few nanoseconds, usually dependent on the mass of the ions.

In time-of-flight mass spectrometers with orthogonal ion injection, a special measurement procedure is used as a rule. Since there is practically no background of erratically occurring scattered ions in these mass spectrometers, each single ion is significant in the analytical sense. In order to measure each single ion with a high degree of certainty, the electronic background noise is suppressed by using a measuring threshold that is so high that electronic noise is no longer measured. The measuring threshold can either be set, for example, electronically on the digitization unit or implemented in the software of the processing method. The amplification of the SEM is then set so that a single ion produces, on average, a signal with an amplitude of 10 to 15 counts above the measurement threshold, for example. This is done so that those ions that produce only a weak signal in the SEM are also measured. Since the impact of the ions only releases a few first-generation secondary electrons, the amplitude of the signals of individual ions varies roughly in accordance with a Poisson distribution. The SEM setting means that ions which release only a single secondary electron, and thus generate a signal of low amplitude, are also measured.

This measuring procedure leads to large regions in both the individual spectra and the sum spectrum being empty, without electronic noise, and the spectra contain only the signals of analytically significant ions. If, at a given time of flight, ion signals are present in practically every individual spectrum acquired, a very high-amplitude signal is generated at this point when the individual spectra are summed; but a low-amplitude signal in the sum spectrum may contain only the signals from ions which have occurred in only every hundredth or thousandth individual spectrum. Some analytical tasks require that around ten ions of a specific mass must be found in one million summed individual mass spectra, which requires around two minutes of measuring time.

As has been briefly mentioned above, this measuring procedure can be improved to increase the time-of-flight resolution of the peaks in the sum spectra. Years of experience have shown that improving the time-of-flight resolution also improves the time-of-flight accuracy because the accuracy is approximately inversely proportional to the resolution. A rule of thumb says that the mass can be accurately determined to within around 1/20 of the width of the peak profile. The resolution of the time of flight is defined as the time of flight divided by the width of the peak at half height, measured in units of the time of flight. Although the full width at half-maximum of an individual ion's peak is only 500 to 1500 picoseconds, depending on the quality of the detector, the summing of several peaks leads to a broadening because ions of exactly the same mass do not impact on the ion detector at exactly the same time of flight due to residual focusing errors in the mass spectrometer, uncompensated effects of the initial energy distributions of the ions before they are pulsed out, and particularly due to the characteristics of the ion detectors. It does not matter here whether the ions occur simultaneously in the same individual spectrum or sequentially in different individual spectra. The broadening of the ion peaks leads to lower time-of-flight resolution and accuracy, and after the times of flight have been converted into masses, it leads to lower mass resolution and lower mass accuracy also. In order to reduce the broadening, example embodiments in U.S. Pat. No. 6,870,156 add the peak intensities obtained from the digitized sequences of measurements of a peak (or even only partial intensities, such as the intensity of the highest measured value) in the sum spectrum only at the times of flight of the maximum measurement of the peak. An ion current signal is thus obtained in the sum spectrum whose width is determined only by the variance of the times of flight of the peak maximum and no longer by the full width at half-maximum of the ion detector. In this way an increased time-of-flight resolution is achieved. The statistical variances of the position of the peak maximum mean that digitized ion current signals with sequences of several intensity values are contained in the sum spectrum. The times of flight of the peaks and the overall intensities are then determined with the aid of a suitable peak detection algorithm.

In the prior art, multichannel plates with an internal channel diameter of around six micrometers were used. Incident ions can penetrate into the channels for some distance, which results in an average penetration depth and a variation of the penetration depths. The variation of the penetration depths is around 10 micrometers. This means that the flight distances also vary by these 10 micrometers. For a total flight distance of two meters, the variations of the flight distances and thus also of the times of flight amount to five parts per million (5 ppm). Due to the quadratic relationship between mass and time of flight, this results in mass variations of ten parts per million (10 ppm). To improve this, there was first a changeover to using multichannel plates with channel diameters of two micrometers; today even secondary electron multipliers with a plane first dynode are used, whose extraordinarily high planarity results in flight distance variations of only around 0.05 micrometers, i.e., mass variations of only 0.1 ppm (100 ppb). Similar improvements are also achieved for other residual ion-optical errors.

By improving the time-of-flight mass spectrometers, the variations in the times of flight of the peaks in the individual spectra caused by residual errors in the ion optics of the instruments become smaller and smaller. Thus, even if several ions occur, the width of the peak of these ions will, in the future, deviate less and less from the signal width of the electron current of a single ion. These improvements have consequences for methods according to U.S. Pat. No. 6,870,156 if these involve the intensities being summed only at the points of the time of flight with intensity maxima. If further improvements mean that the ion-optical variances increasingly disappear, the maxima of the measurements of a peak will appear increasingly at precisely the same time of flight. In the end, signals appear in the sum spectrum, which have intensity entries only at this one single position. For the signal detection methods, this means that the technique of forming centers of gravity (centroids) over several entries in the sum spectrum can no longer be used to achieve a more exact time-of-flight determination than corresponds to the time raster of the measurements in the digitizing unit. If a digitizing unit with a 5 gigahertz measuring rate is used, the times of flight of the ions of one species can only be determined with a best accuracy of 200 picoseconds. This results in systematic errors which cannot be corrected.

The problem of incorrect masses can be explained in more detail using the digitized ion peak which is shown in FIG. 2. If this peak is reproduced identically in a mass spectrometer of ideal quality, the ion intensities are always added at measurement raster location 3 on the abscissa in accordance with an embodiment of U.S. Pat. No. 6,870,156. However, since the peak, characterized by its center of gravity (in short "centroid"), is positioned at location 2.6 on the abscissa, and the abscissa shows time-of-flight intervals of 200 picoseconds each, the addition is always carried out at a wrong position with an error of 80 picoseconds with respect to the position of the centroid. If, for example, the ions with a mass of m/z=1000 atomic mass units appear at a time of flight of 40 microseconds, a systematic error of 2 ppm results for their time of flight, and 4 ppm for the mass. This is an extremely large error given a desired mass accuracy of 200 ppb. Even if improvements to the mass spectrometers are not yet so far advanced that this maximum error occurs, nevertheless this example shows that errors of this type cannot be accepted.

Similar considerations concerning incorrect times of flight of ion current signals also apply to the method which is disclosed in U.S. Pat. No. 7,412,334.

There is a need to provide method and apparatus with which individual spectra of a time-of-flight mass spectrometer are processed to give sum spectra which have both a higher time-of-flight resolution and a better accuracy in determining the times of flight of the peaks compared to a sum spectrum comprised of summed individual spectra.

SUMMARY OF THE INVENTION

Individual spectra of a time-of-flight mass spectrometer and the sum spectrum each consist of sequences of digitized intensity values on a time-of-flight axis which is predetermined by the mode of operation of a time-of-flight mass spectrometer and whose zero point in time is, for example, determined by the acceleration pulse in a pulser. The intensity values of the individual spectra are represented and stored as entries in a storage memory divided into a measuring time raster, those of the sum spectra in an addition raster, both on the time of flight axis. For the simple summation of individual spectra to form sum spectra, both rasters must have the same time intervals, but for this invention it is also possible to use rasters of different widths. For example, the addition raster of the sum spectra can have time-of-flight intervals which amount to a quarter of the time-of-flight intervals of the measuring time raster of the individual spectra; nevertheless, for this invention the same time intervals in both types of spectra are also largely preferred.

In the time-of-flight mass spectrometers with orthogonal ion injection, the individual spectra continuous sequences of around four to fifteen intensity values can be recognized exceeding a given threshold value and forming an "ion current signal" or a "peak".

A method is provided for processing individual spectra of a time-of-flight mass spectrometer to form a sum spectrum which neither adds together all the measured intensity values in the sum spectrum, nor adds the total intensity of a peak at only one intensity value of the sum spectrum, but instead adds the total intensity to the sum spectrum in such a way that the information on the time of flight of the peak is maintained as far as possible in the contributions being added. To this end, first the time of flight of the peak ("peak position" on the flight time axis) and the total intensity of a peak in the individual spectrum are determined, and intensity entries in the addition raster adjacent to the peak position are selected in the sum spectrum; then the total intensity is divided up into intensity portions, which are added to the selected intensity entries of the sum spectrum in such a way that more of the total intensity is added to the intensity entries, the flight times of which are closer to the peak position than is added to the intensity entries the flight times of which are more distant from the peak position. The total intensity is added to the intensity entries of the sum spectrum in portions that are inversely proportional to the distance of the intensity values from the position of the ion current signal. The number of intensity portions should be as small as possible; most preferable are two portions which are added to two intensity entries of the sum spectrum on both sides of the peak position, preferably to the immediately adjacent intensity entries of the addition raster.

To determine the peak position of an ion current signal, it is possible to use an optimization method, fitting a mathematical curve into the digitized ion current signal in the individual spectrum, for example. However, it is generally more favorable to determine the peak position by calculating the center of gravity (below often termed as "centroid") of the measurement value sequence of the peak from the individual spectrum. In a preferred embodiment, the total intensity is the sum of all measurements belonging to the peak, but the maximum measurement of the peak, or a peak maximum determined from the fitted curve, can also be used, for example.

Reduced sum spectra are obtained which are qualitatively so good in terms of their time-of-flight resolution, time-of-flight accuracy and quantitative representation of ion mixtures, their intensity accuracy for isotopic distributions, for example, that it is no longer necessary to sum all the individual measurements to form a "non-reduced sum spectrum". This in turn means that the digitizing devices currently used can be greatly simplified.

These and other objects, features and advantages of the present invention will become more apparent in light of the following detailed description of preferred embodiments thereof, as illustrated in the accompanying Figures.

DETAILED DESCRIPTION OF THE INVENTION

Definitions and terminology for the example embodiments below: in the following, a "peak" or a "digitized ion current signal" includes of a continuous sequence of measurements $W_i$, which are all greater than a threshold value $W_{lim}$, limited at both sides by two measurements $W_i$, which are less than or equal to the threshold value $W_{lim}$. A "non-reduced sum spectrum" includes of a complete summation of all measurements, including all measurements of the noise; a "reduced sum spectrum" contains only the sums of the total intensities of the peaks at positions on both sides of the peak position determined for this peak, divided up in such a way that the information on the exact peak position remains intact in the contribution of this peak to the reduced sum spectrum. If the peak position is determined via the centroids of the peak, the centroids shall remain intact in the contribution of this peak added to the reduced sum spectrum.

A "listed time-of-flight spectrum" contains only the positions and total intensities of the peaks from the reduced sum spectrum, obtained by any peak finding algorithm. A "listed mass spectrum" contains the masses m/z of the ion peaks obtained from the listed time-of-flight spectrum by applying a "calibration function" (a function with parameters whose parameter values were obtained in a calibration procedure) and the total intensities of the peaks, possibly also the widths of the peaks in the reduced sum spectrum, converted to widths in mass units. An "isotopic reduced listed mass spectrum" contains only the masses of the monoisotopic ions, the total intensity of the isotopic group and possibly the peak widths averaged over the peaks of the isotopic group.

A "digitized ion current signal" or "peak" can also, in a slightly different way, be characterized by the fact that the sequence of values starts when the difference $(W_{i+1}-W_i)$ of two consecutive measurements exceeds a threshold $\Delta_{lim}$ for these differences, and ends, after surmounting a maximum value, when the difference $(W_i-W_{i+1})$ drops below this threshold again.

Figure 1:
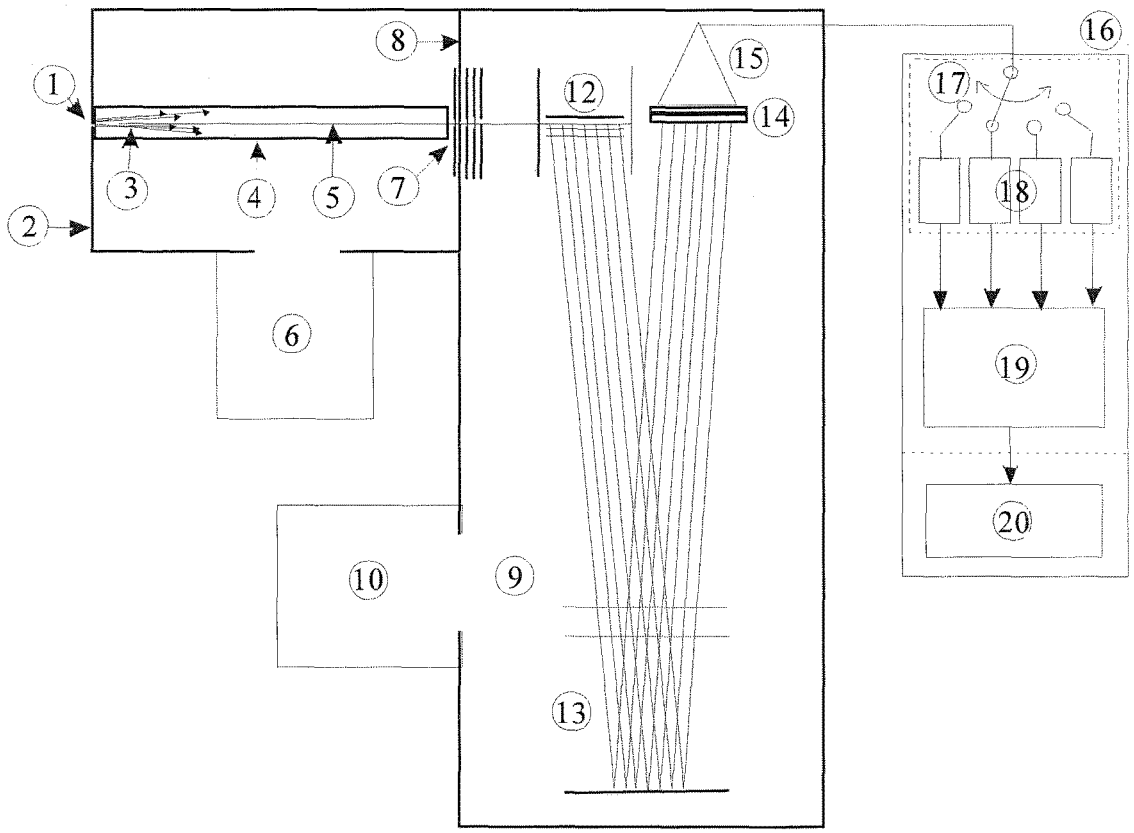
FIG. 1 is a schematic illustration of a time-of-flight mass spectrometer with orthogonal ion injection, equipped with measurement processing means according to an aspect of the present invention.
Figure 2:
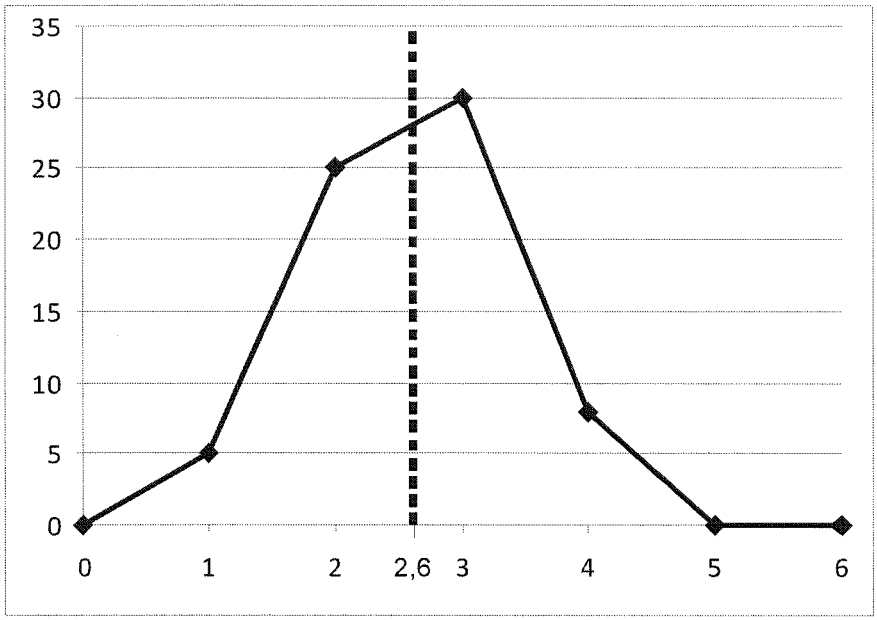
FIG. 2 is a graphic illustration of the sequence of digital values of a peak from an individual spectrum whose maximum is at the abscissa value 3.0, but whose centroid (center of gravity) is at 2.6.
Figure 3:
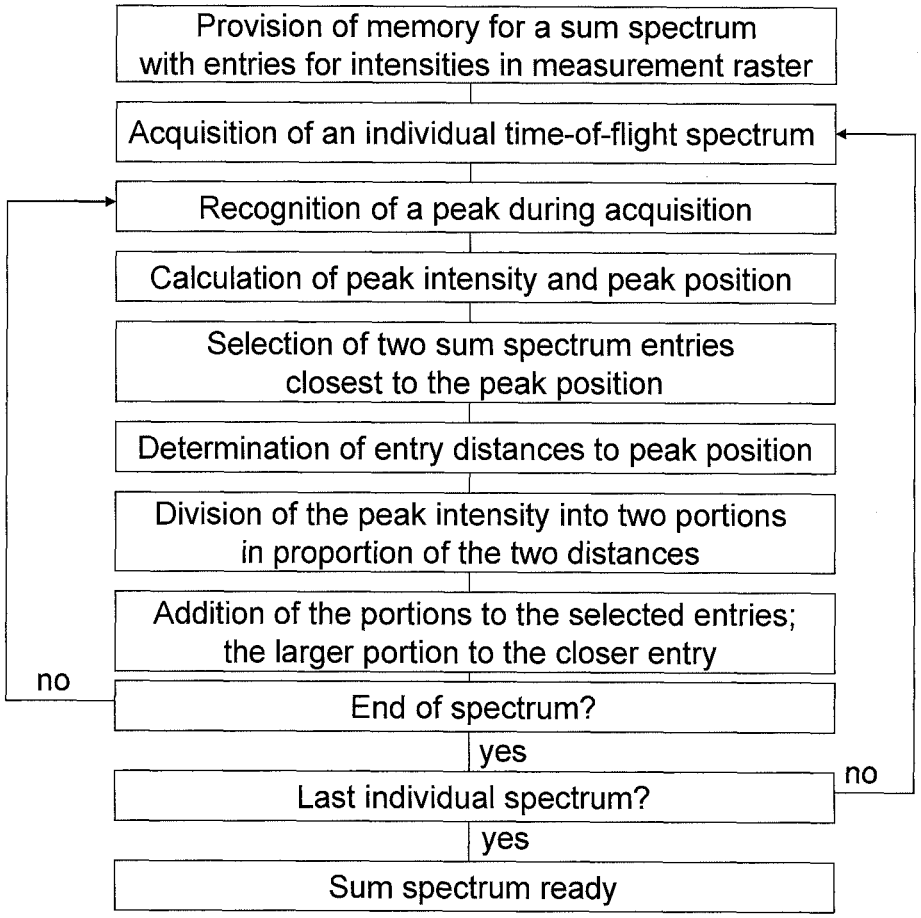
FIG. 3 is a flow diagram illustration for a measurement and processing method for generating a sum spectrum.

Referring to still to FIG. 1, in time-of-flight mass spectrometers with orthogonal ion injection (OTOF), a fine continuous ion beam 5 is generated, and a pulser 12 periodically injects sections from this ion beam into the drift region of the mass spectrometer, at right angles to the original direction of the ion beam. Initial distributions of the ions in space and velocity are compensated as far as is possible in this process. The ions are often generated outside the mass spectrometric vacuum system by electrospraying. The repetition rates of the ion injection (and thus also the spectrum acquisition rates) are set at 5 to 30 kilohertz. A bundle of ions with different initial energies and initial directions enters an ion guide 4 together with a damping gas through an aperture 1 of a vacuum chamber 2 equipped with a vacuum pump 6. In the gas, the entering ions are decelerated by collisions so that they collect on the axis 5 as a fine ion beam. A puller lens system 7 in the wall 8 between the vacuum chambers 2 and 9 transfers the fine ion beam 5 from the ion guide 4 to the pulser 12. Once the pulser 12 is filled with transiting ions, a short voltage pulse ejects a broad packet of ions at right angles to the previous direction of flight and forms a wide ion beam comprising individual ion packets, separating according to mass during their flight, which are reflected in a reflector 13 so as to be focused according to their energy and are measured with high temporal resolution by an ion detector 14, 15. The electron current 15 at the exit of the ion detector is fed to the digitization unit 16; the digitization unit contains a module with four parallel analog-to-digital converters (ADCs) 18 and cyclic switching 17 and an arithmetic unit 19 which sums its output values into a reduced sum spectrum in a data memory 20 which may be contained in a PC.

When a peak, usually including a sequence of four to fifteen measurements $W_i$, is recognized by the evaluation program inside the arithmetic unit, it is a first measure according to an aspect of the invention to calculate the total intensity and the position of the peak. The "position" of the peak on the flight time scale has the physical dimension of time, in spite of the fact that the term "position" usually has the physical dimension of a length. Several methods can be used to determine the peak position. For example, a mathematical curve can be fitted into the sequence of measurements $W_i$ of a peak with the aid of an optimization method, and the position of this curve then represents the peak position. Alternatively, the centroid (center of gravity, first moment) of the peak is determined from the digitized measurements $W_i$, and this centroid is used as the peak position.

In the following, an embodiment of the invention is described in detail using the determination of the centroids of the ion current signals, without this description of course limiting the scope of the invention to this embodiment.

In FIG. 1, measurements $W_i$ generated by ADCs 18 of the digitization unit 16 are supplied to the arithmetic unit 19. The arithmetic unit 19 may be a Field Programmable Gate Array (FPGA); alternatively an arithmetic unit of a Digital Signal Processor (DSP) or an Application Specific Integrated Circuit (ASIC) can be used instead of the FPGA. To buffer the values, one or more fast FIFOs (first-in-first-out memory) can be inserted, or preferably formed within in the FPGA. It is assumed that the ADCs 18 are adjusted so that the average of the electronic noise just results in zero counts and a measurement threshold $W_{lim}$ is used in the arithmetic unit which is used to eliminate the electronic noise from the measurement values.

The arithmetic unit 19 uses the first occurrence of a measurement greater than $W_{lim}$ to ascertain the start time of a peak. At this time the formation of the two sums $S_p=\Sigma(iW_i)$ and $I_t=\Sigma(W_i)$ from the continuously arriving values $W_i$ begins. The index i here represents the count of the time raster points, corresponding to the times of flight at which the measurements are performed. When the end of the peak is detected by a measurement dropping below the threshold, the position $P_p$ of the peak's centroid on the index scale of raster points is calculated as $P_p=\Sigma(iW_i)/\Sigma(W_i)=S_p/I_p$. The index i runs over all measurements of an individual spectrum.

In a preferred embodiment, the total intensity $I_p$ of the measurements of the ion current signal is now divided into two portions to be added to two positions in the reduced sum spectrum so that the centroid of the contribution of this peak is maintained. The two portions are preferably added to the two intensity entries of the reduced sum spectrum, the flight times of which are directly adjacent to the two sides of the centroid position $P_p$. The division of the total intensity $I_p$ into portions is then simply done according to the proportions of the distances of the centroid positions $P_p$ to its two neighboring positions in the addition raster of the reduced sum spectrum. As desired, this method removes the systematic errors that originate from the fact that the intensities are only added at the time of flight of the maximum measurement of the ion current signal, as in example embodiments in U.S. Pat. No. 6,870,156. The reduced sum spectrum can be formed directly in the data memory of a PC if the digitization unit 16 is on a plug-in board in a PC.

It is also possible to suppress the electronic noise by adjusting the electronics, in this case the ADCs in particular. Then $W_{lim}=0$ applies. In order to then obtain true measurements, the measurement threshold set via the hardware must be added to the measurements. If the electronic noise is not suppressed by the hardware, but the measurement threshold $W_{lim}$ is used in the arithmetic unit, the measurement threshold $W_{lim}$ can even be made dependent on the time of flight, if it should be found that, for any reason, the electronic noise changes as a function of the time of flight while an individual spectrum is being acquired.

Occasionally the electronic noise exhibits random or non-random outliers. Then one, two and sometimes even three measured values above the measurement threshold $W_{lim}$ occur, for example as a result of induced signals from electrical switching in the vicinity. These outliers are detected by small numbers $n<n_{min}$ for the number n of measurements in the non-real peak, and the peak can then be discarded by the processing program.

The reduced sum spectra now contain sequences of values for peaks, but these sequences of values are much narrower for a peak than the sequences of values that would have been obtained by summation of all the measurements of the individual spectra to form non-reduced sum spectra. This results in a time-of-flight resolution that is higher than that of non-reduced sum spectra. Listed time-of-flight spectra, which contain only the peak positions of the "reduced peaks" and their total intensities, are now obtained from the reduced sum spectra with the aid of suitable peak detection algorithms ("peak recognition methods"). The peak positions can again be centroids. Instead of the centroids, the peak detection method can also determine other characteristic values for the position of the peak, and these values can then be used in the listed time-of-flight spectrum. Some peak detection methods even use the known distribution of the intensities of an isotopic group, i.e., they are based on several associated peaks. These detection methods for isotopic groups often only provide the times of flight of the monoisotopic peaks, although this method makes them particularly accurate; they usually provide "isotopic reduced listed time-of-flight spectra". All listed time-of-flight spectra form only numerical lists with the times of flight of the peaks and the associated total intensities. They can be graphically represented as line spectra. From such a listed time-of-flight spectrum, a listed mass spectrum (or an "isotopic reduced listed mass spectrum) is then obtained by applying the calibration function, which calculates the mass as a function of the time of flight. These listed mass spectra exhibit the desired high mass accuracy because now the systematic errors which were introduced by adding the intensities at the intensity maxima are removed.

When the processing of the invention is applied, mass spectra are obtained that are qualitatively so good in terms of mass resolution, mass accuracy and quantitative characteristics, because all the centroids of the original peaks are preserved, that it is no longer necessary to sum all the individual measurements to form a non-reduced sum spectrum. This in turn means that the digitizing devices currently used can be simplified.

Until now all digitization devices have been developed with the aim of summing all measurement values in real time to form non-reduced sum spectra, even if no measurement threshold to suppress the electronic noise is used. For a time raster of 200 picoseconds (at a sampling rate of five gigahertz), several converters must be operated in parallel in a cyclic fashion due to the limited time available, and it has been necessary to process the summations in parallel to generate a non-reduced sum spectrum. Even if extremely fast data memories are used, the non-reduced sum spectrum cannot be generated within the time raster of the measurements in a single processing line because every addition requires reading of the current summation entry from the sum spectrum, adding the measurement and writing back, all of which requires many cycles of the arithmetic unit. It is therefore necessary to arrange several very fast (and very expensive) memory modules in a complicated parallel fashion and to use summation algorithms operating in parallel in complex arithmetic units. Extremely fast FPGA are usually used as arithmetic units for this task. If further tasks are required, such as finding the maximum for ion current signals, the algorithm becomes even more complex because essentially the measurements are processed in parallel processing lines, but finding the maximum requires comparisons across the parallel processing strands. Reading out the completed sum spectrum again takes time because the values must be read from the individual memory modules and put into the correct sequence. The time for this data transmission to the PC amounts to between 5 and 20 milliseconds, and limits the maximum rate for spectrum acquisition to around 20 mass spectra per second for the current mode of operation.

If, however, the objective of immediate summation to give non-reduced sum spectra is dropped, the task of the digitization units is simplified. The parallel data banks comprising very fast memory modules are no longer required. In the most favorable case, the reduced sum spectrum is formed directly in the memory of the connected PC and is available as soon as the measurements are concluded, without further reading out. The complicated summation of values into several data banks is thus also superfluous. In a simple embodiment, the arithmetic unit, an FPGA, for example, can calculate the centroid times and total intensities of the peaks, preferably already divided into two partial values, and transfer these values to the PC, which performs the adding to the reduced sum spectrum. It is even more favorable if a FPGA, a DSP or an ASIC on a circuit board in the PC has direct access to the data memory of the PC and can directly generate the reduced sum spectrum there. The incoming measurement values may be buffered in one or more FIFOs of sufficient size, however, although it is also possible to program these FIFOs in an FPGA or ASIC. Since there are 1000 peaks at most in an individual time-of-flight spectrum (if only to avoid strong oversaturation of the ADCs), only a maximum of 2000 additions (usually far fewer) are required for a 100 microsecond time-of-flight spectrum with 500,000 measurements, which means a considerable reduction in data transmission and summation.

The digitization unit 16 can therefore be designed in a much simpler way. For example, on a plug-in circuit board in the PC there can be essentially only one module with four parallel ADCs 18 with cyclic switching 17 in the input region and an arithmetic unit 19, an FPGA, DSP or ASIC, for example, with access to the data memory 20 of the PC. In an FPGA or an ASIC, parallel FIFOs can also be installed for data buffering, for example. In the arithmetic unit 19, the sums for calculating centroids and total intensities are formed, the centroids are calculated and the total intensities are divided, before the portions of the total intensity are added to the sum spectrum in the data memory 20 of the PC. The four parallel ADCs 18 with cyclic switching 17 in the input region are commercially available as ready-made modules. The arithmetic unit 19 accesses the data memory 20 in the PC via the PC databus, which is accessible from the plug-in circuit boards.

The reduced sum spectra form the basis for further processing. On the one hand, the reduced sum spectra have to be displayed on the display of the mass spectrometer. The time-of-flight resolution is thus visible in these reduced sum spectra; observing the reduced sum spectrum is therefore important for adjusting the mass spectrometer in order to obtain the maximum time-of-flight resolution. In addition, the reduced sum spectrum shows many details, such as overlaps of isotopic patterns of different ion species. The scale of the abscissa of these sum spectra can be converted from times of flight to masses here, or significant peaks are provided with numerical information of their masses.

Time-of-flight lists of the peaks with their intensities, i.e., listed time-of-flight spectra, are usually produced from the reduced sum spectra by applying peak detection programs. The listed time-of-flight spectra contain only the precise times of flight of the centroids and their intensities. Instead of the centroids of the ion peaks, other position parameters can be determined: the position of an ion peak can be determined with the aid of a peak detection program by fitting a theoretical curve, this being performed by an optimization program. Hence, when the term "centroid of an ion peak" is or has been used here, it may also refer to another characteristic position parameter for the peak in a broader sense.

A particularly successful detection method for ion peaks, which has become known under the name "SNAP", uses the whole isotopic pattern to determine the exact position of monoisotopic peaks on the time-of-flight scale. The isotopic pattern, as a function of the mass, is sufficiently well-known for each substance class whose composition of the elements (such as the proteins) exhibits largely the same concentration relations. Here the synthetically reproduced isotopic pattern with peaks of suitable widths is fitted into the pattern of the measured peaks with the aid of an optimization method. This method provides several advantages: on the one hand, the monoisotopic peak is detected with certainty, which for very heavy ions in particular is not easy to detect; and on the other hand, the accuracy of the time-of-flight determination is increased because several peaks are considered simultaneously; and thirdly, overlaps of isotopic patterns are detected and separated by calculations.

The listed time-of-flight spectra are then transformed into listed mass spectra with the aid of calibration functions. The parameters of the calibration functions are determined as usual by acquiring spectra of calibration substances the ion mass values of which are precisely known. From the isotopic reduced listed time-of-flight spectra, the isotopic reduced listed mass spectra are then obtained with the calibration curve.

Sometimes it is desired to also graphically represent the full mass spectra with their peaks of finite width from listed mass spectra or even isotopic reduced listed mass spectra. This can be done by converting a reduced sum spectrum point by point, for example, although this leads to a distorted, no longer linear mass scale. It is often simpler, and sufficient for the present purpose, to reconstruct the analog image of the mass spectrum with its isotopic pattern and its peaks of finite width. This requires (in addition to the calculation of the isotopic pattern) knowledge of the width of the peaks, however. The width of the peaks is in general a function of the mass; the width and its dependence on the mass can, for example, be determined once using the reduced sum spectrum and be stored with the listed mass spectrum. It is also possible to list the width of the peaks for each peak in the list of the mass spectrum. The widths of the reduced peaks can be calculated as the second moment of the peak in the known way, together with the calculation of the centroid as the first moment. They can also result from the peak recognition procedure, however.

The knowledge of the peak widths in the reduced mass spectrum can also be used in order to detect unresolved overlaps of peaks of ions of different species and mass. The peak widths of non-overlapping peaks exhibit a monotonic dependence on the time of flight and a variation about the respective averages, whereby the variations are not very large. If the width of a peak is now larger than the expected peak width by more than a certain percentage, by 25 percent for example, it can be assumed that two ion species of slightly different mass are present here. It is then possible to assume an overlap and separate them computationally in a way which is principally known, when the listed time-of-flight spectrum is compiled.

In principle, the widths of the peaks in the individual spectrum can also be calculated as the second moment in the known way, together with the calculation of the centroid as the first moment. Since this calculation requires considerable additional work, however, it is simpler to check the peak width from the first to the last measurement on the basis of the number of measurements above the measurement threshold. If this peak width is too great, the measurement values of the peak can be transferred in a continuous sequence into the PC, where they are subjected to a special analysis. This case is extraordinarily rare, however, since it requires the simultaneous arrival of ions of several masses, i.e., the overlapping of two high-amplitude ion signals, but the occurrence of high-amplitude ion signals is in itself rare. It is seldom that more than ten such high-amplitude ion signals are to be found in a mass spectrum; overlaps of two such peaks are therefore extremely unlikely.

For low-amplitude ion signals, which are comprised of ions which only occasionally occur once in a time-of-flight individual spectrum, the overlap only becomes detectable in the reduced sum spectrum. Many peaks which would appear unresolved in a non-reduced sum spectrum are already resolved here due to the reduced peak width. As has been described above, unresolved overlaps can be separated computationally in the usual way. It is especially favorable here to use the SNAP method.

Although the present invention has been illustrated and described with respect to several preferred embodiments thereof, various changes, omissions and additions to the form and detail thereof, may be made therein, without departing from the spirit and scope of the invention.

What is claimed is:

1. Method for operating a time-of-flight mass spectrometer comprising an ion source, a pulser, a drift region, a reflector, an ion detector with a secondary electron multiplier, a digitization unit, and a data memory, to form a sum spectrum, comprising the steps of:

pulsing ions into the drift region of the time-of-flight mass spectrometer;

sampling the electron current which is generated by the ion current in the secondary electron multiplier of the ion detector at the end of the drift region to thereby acquire an individual spectrum;

determining for at least one ion current peak in the individual spectrum, a position of the ion current peak on a flight time scale and a total intensity;

selecting entries in an addition time raster of the sum spectrum, which are adjacent to the position of the ion current peak; and in an arithmetic unit that has access to the data memory, adding portions of the total intensity of the ion current peak to the selected entries to increase the time-of-flight resolution of the mass spectrometer, wherein more of the total intensity is added to the entries which are closer to the position of the ion current peak than is added to the entries which are further away from the position of the ion current peak.

2. Method according to claim 1, wherein the added portions of the total intensity are inversely proportional to the distance of the selected entries from the position of the ion current peak.

3. Method according to claim 1, wherein the total intensity is added to two entries in the addition time raster of the sum spectrum, which are directly adjacent of the position of the ion current peak on both sides.

4. Method according to claim 1, wherein the position is determined by best fitting a mathematical curve to the measured ion current of the at least one ion current peak in the individual spectrum.

5. Method according to claim 1, wherein the position is determined by calculating a center of gravity of the measured ion current of the at least one ion current peak in the individual spectrum.

6. A method for operating a time-of-flight mass spectrometer comprising an ion source, a pulser, a drift region, a reflector, an ion detector with a secondary electron multiplier, a digitization unit, and a data memory, to form a sum spectrum, comprising the steps:

pulsing ions into the drift region of the time-of-flight mass spectrometer;

sampling the electron current which is generated by the ion current in the secondary electron multiplier of the ion detector at the end of the drift region to thereby acquire an individual spectrum;

in an arithmetic unit that has access to the data memory (i) calculating of total intensity and position on a flight time scale of a ion current peak in the individual spectrum, the latter as a center of gravity of measurement values of the ion current peak in the individual spectrum; (ii) selecting two entries in an addition time raster of the sum spectrum, the flight times of which are closest to the position of the ion current peak; (iii) determining distances, on the flight time scale, of the flight times of the two selected entries from the position of ion current peak; (iv) dividing the total intensity into two portions in proportion of the two distances, and (v) adding the two portions to the two selected entries, with the larger portion being added to the entry which is closer to the position of ion current peak.

7. Method according to claim 6, wherein the ion current peak in the individual spectrum is a continuous sequence of values $W_i$ of the measured ion current, which all exceed a measurement threshold $W_{lim}$.

8. Method according to claim 7, wherein the measurement threshold $W_{lim}$ depends on the time of flight.

9. Method according to claim 7, wherein the ion current peak starts with a first measurement value showing a difference $(W_{i+1}-W_i)\leq\Delta_{lim}$, $\Delta_{lim}$, being a difference threshold, and ends when a measurement difference $(W_i-W_{i+1})$ drops below the difference threshold $\Delta_{lim}$.

10. Method according to claim 1, wherein the peak position and the total intensity of the at least one ion current peak is determined in an arithmetic unit coupled to a plurality of analog-to-digital converters of the ion detector.

11. Method according to claim 10, wherein the arithmetic unit is one of a Field Programmable Gate Array (FPGA), a digital signal processor (DSP) and an Application Specific Integrated Circuit (ASIC).

12. Method according to claim 10, wherein intensity values of the sum spectrum are stored in the data memory of a PC and the portions of the total intensity are added to the selected entries in the addition time raster by direct access between the arithmetic unit and the data memory of the PC.

13. Method according to claim 10, wherein intensity values of the sum spectrum are stored in the data memory of a PC, the position and the total intensity of the ion current peak are transferred from the arithmetic unit to the PC and the portions of the total intensity are added to the selected entries in the addition time raster by the PC.

14. Method according to claim 7, wherein the sum $Sp=\Sigma(iWi)$ and the total intensity $Ip=\Sigma(Wi)$ are calculated from a measurement value sequence Wi of the peak, from which the position of the ion current peak $Pp=\Sigma(iWi)/\Sigma(Wi)=Sp/Ip$ as center of gravity on the flight time scale is determined.

15. A time-of-flight mass spectrometer comprising: an ion source; an ion guide; a pulser; a drift region; a reflector; an ion detector with a secondary electron multiplier; a digitization unit; and a data memory, wherein the pulser is arranged between the ion guide and the drift region and is configured to eject a packet of ions at right angles to the axis of the ion guide into the drift region, wherein the digitization unit comprises a module with a plurality of analog-to-digital converters and an arithmetic unit, said analog-digital converters being connected in parallel and configured to sample the electron current generated by the ion current in the ion detector at the end of the drift region to thereby acquire an individual spectrum, and wherein the arithmetic unit has access to the data memory and is configured (i) to determine the position of at least one ion current peak on a flight time scale of the individual spectrum as well as the total intensity of the at least one ion current peak, (ii) to select entries in an addition time raster of the sum spectrum, wherein the addition time raster is stored in the data memory and the selected entries are adjacent to the position of the at least one ion current peak, and (iii) to sum portions of the total intensity of the at least one ion current peak to the selected entries, wherein more of the total intensity is summed to selected entries which are closer to the position of the at least one ion current peak than is added to the selected entries which are further away from the position of the at least one ion current peak.

16. The time-of-flight mass spectrometer of claim 15, wherein the arithmetic unit is configured to select two entries in the addition time raster of the sum spectrum.

17. The time-of-flight mass spectrometer of claim 16, wherein the data memory is the data memory of a PC and the arithmetic unit has access via a databus.

18. The time-of-flight mass spectrometer of claim 17, wherein the arithmetic unit is one of a Field Programmable Gate Array (FPGA), a digital signal processor (DSP) or an Application Specific Integrated Circuit (ASIC).

* * * * *